United States Patent [19]

Mohr

[11] 4,435,959

[45] Mar. 13, 1984

[54] HOT-GAS PISTON-TYPE ENGINE AND USE THEREOF IN HEATING, COOLING AND POWER PLANTS

[75] Inventor: Ernst Mohr, Murten, Switzerland

[73] Assignee: Fides Treuhand GmbH, Wuppertal, Fed. Rep. of Germany

[21] Appl. No.: 275,787

[22] Filed: Jun. 22, 1981

[30] Foreign Application Priority Data

Jul. 1, 1980 [EP] European Pat. Off. ..... 80810217

[51] Int. Cl.[3] ..... F01B 29/08

[52] U.S. Cl. ..... 60/512; 60/648; 60/682; 62/6; 237/12.1

[58] Field of Search ..... 60/508, 512, 516, 517, 60/650, 669, 682, 648; 62/6; 237/12.1

[56] References Cited

U.S. PATENT DOCUMENTS

| | | | |
|---|---|---|---|
| 966,032 | 8/1910 | Mann | 60/517 |
| 3,858,802 | 1/1975 | Stobart | 62/6 X |
| 4,008,574 | 2/1977 | Rein . | |
| 4,077,216 | 3/1978 | Cooke-Yarborough | 62/6 X |
| 4,183,213 | 1/1980 | Rao . | |

FOREIGN PATENT DOCUMENTS

| | | |
|---|---|---|
| 868806 | 1/1953 | Fed. Rep. of Germany . |
| 1173608 | 7/1964 | Fed. Rep. of Germany . |
| 2154714 | 11/1971 | Fed. Rep. of Germany . |
| 2433947 | 7/1974 | Fed. Rep. of Germany . |
| 2522711 | 5/1975 | Fed. Rep. of Germany . |
| 2633233 | 7/1976 | Fed. Rep. of Germany . |
| 2826603 | 6/1978 | Fed. Rep. of Germany . |
| 2227430 | 11/1974 | France . |
| 560318 | 3/1975 | Switzerland . |
| 689484 | 3/1953 | United Kingdom . |

*Primary Examiner*—Allen M. Ostrager
*Assistant Examiner*—Stephen F. Husar
*Attorney, Agent, or Firm*—Wender, Murase & White

[57] ABSTRACT

A hot-gas piston engine (4) has, as a compression chamber, a heat exchanger (6) which comprises a number of small pipes (7) or differently designed capillaries which protrude into the burner chamber (5) of a burner (1). In the compression phase, air in the small pipes (7), which serve as the compression chamber, is compressed and additionally heated by the burner flame, whereby the pressure increases, and the piston is driven to execute a downward movement. The scavenging then occurs in the bottom dead center region. The hot outgoing air from the engine enters burner supply line (10) and then the burner, whereby the efficiency of the plant is increased even further. The mechanical energy received at the driven shaft (11) may be used to produce electrical energy or to operate a heat pump. The upper ends of the small pipes protrude into the hot water whereby they are protected from overheating.

Such gas piston-type engines may be used either to produce mechanical energy or as a heat pump or as a refrigeration unit in heating and refrigeration plants or gas turbine plants. The overall efficiency of a plant may be substantially increased by the use of such gas piston-type engines.

The heat exchanger is referenced 6,37,45,50,59,63.

28 Claims, 12 Drawing Figures

HOT-GAS PISTON-TYPE ENGINE AND USE THEREOF IN HEATING, COOLING AND POWER PLANTS

BACKGROUND OF THE INVENTION

The present invention relates to a hot-gas piston-type engine having a heat exchanger and to the use of same in various plants such as heating and cooling or refrigeration plants, and gas turbine plants.

On the one hand, a number of heat engines or so-called Stirling engines are known which are driven by an external heat source, such as, for example, those according to German Offenlegungsschrift No. 26 33 233 or U.S. Pat. No. 4,008,574. In these publications, the main object is to improve the efficiency of the heat engines. On the other hand, heating plants are known to which a hot-air or hot-gas engine is connected. Thus, for example, in German Offenlegungsschrift No. 25 22 711, a power unit is described which comprises a combustion plant and at least one hot-gas engine which is connected to the combustion system by means of regenerative heat exchangers.

While the two first-mentioned publications relate to the improvement in the heat engine, or Stirling engine respectively, the last-mentioned publication is concerned with improving the efficiency of a large-scale plant. By comparison, an object of the present invention is to provide an apparatus or engine and indicate its possible uses, this engine, on the one hand having a high efficiency and, on the other hand, also being able to be used in a relatively small to medium plant, for example in a block of flats or for heating a small business.

SUMMARY OF THE INVENTION

According to the present invention there is provided in a hot-gas piston-type engine, a heat exchanger, said exchanger being constructed to act as compression space for a cylinder.

BRIEF DESCRIPTION OF THE DRAWINGS

The invention will now be explaineed more fully, by way of example, with reference to the accompanying drawings, in which.

DETAILED DESCRIPTION OF THE INVENTION

Figure 1:
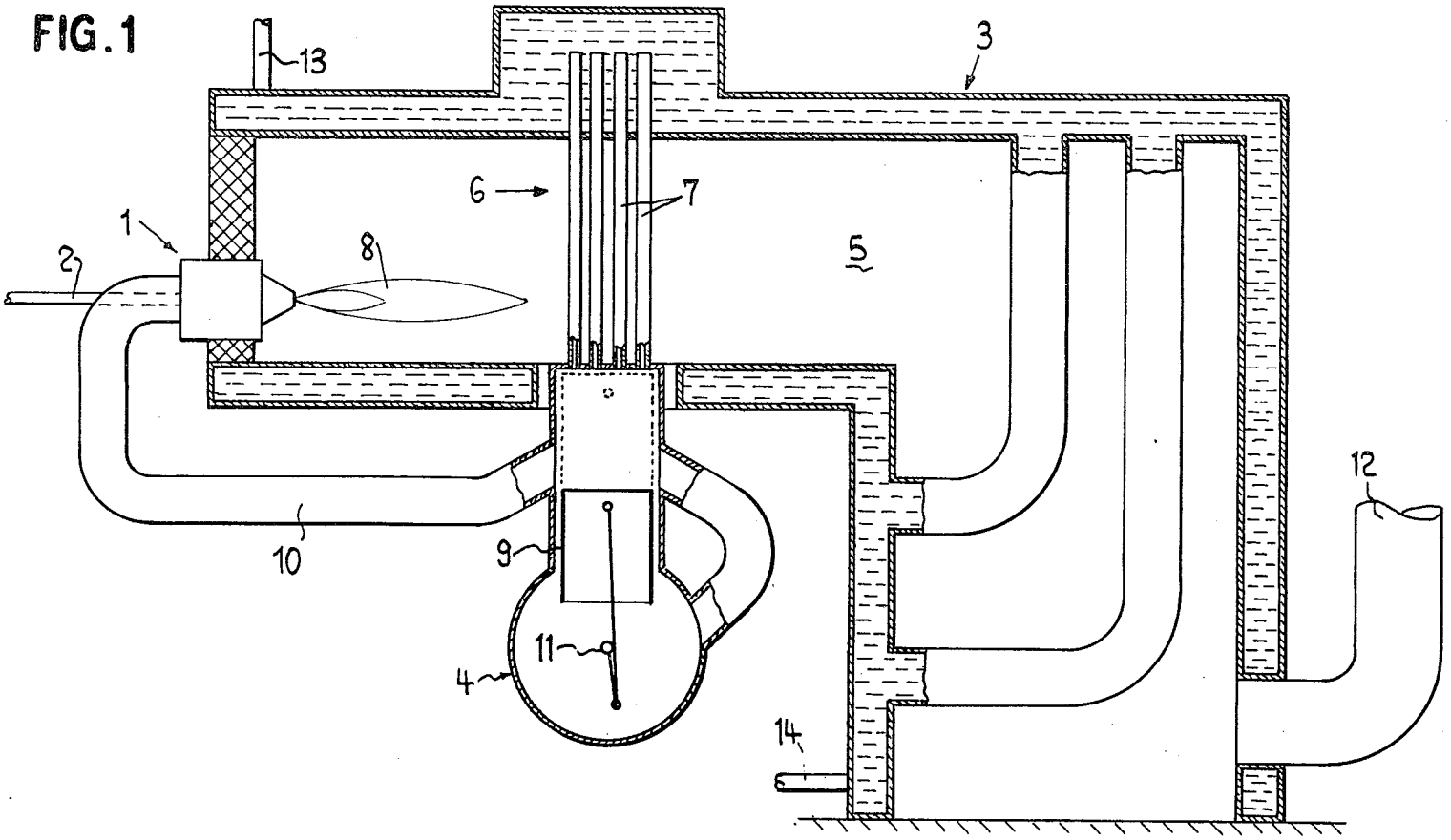
FIG. 1 is a schematic illustration of a hot-gas piston-type engine according to the invention in a combustion plant.

FIG. 1 shows a burner 1 (which, for example, has an output of 10 kg heating oil per hour) and an oil supply line 2, a hot water boiler 3 and a hot-air engine 4 having a heat exchanger 6 which protrudes into burner chamber 5. In this example, the hot-air engine 4 is a two-cycle (or stroke) hot-air engine, having for example, an output of 10 kw and four cylinders with a total capacity of 6000 $cm^3$. The heat exchanger 6 comprises a number of small tubes or pipes 7. In the present example, there are 150 small pipes per cylinder with a $\phi$ of 2.5 mm and a length of 500 mm. In this embodiment the small pipes are disposed relative to flame 8 so that the small pipes of one cylinder are heated as uniformly as possible.

The mode of operation is as follows: The scavenging process occurs in the bottom dead centre region of the piston 9 of one cylinder, i.e. the heated air emerges from the cylinder and is supplied to the burner 1 as hot combustion air, with a temperature of, for example, 300° C., while the cold fresh air enters the cylinder (crankcase scavenging). During the subsequent compression, the air enters the small pipes of the heat exchanger 6, these pipes being heated by the hot gases of the burner flame and transmitting the heat to the trapped air. This produces an increase in pressure and the piston executes the downward movement. The scavenging process, etc. then occurs again in the region of bottom dead centre position.

By using small pipes 7 or the like which form the upper end of the compression chamber and whereby the air contained therein is heated very quickly, it is no longer necessary to use otherwise conventional separate heat exchangers with valves. The number and size of the small pipes are to be adapted to the strength and size of the flame, and to the cycle of the piston. In this embodiment, the effective surfaces of the small pipes 7 are designed so that the heat is transmitted sufficiently quickly to the working gas. An increase in the overall efficiency is also achieved in that preheated combustion air is supplied to the burner via the supply line 10. Because the small pipes 7 project into the hot water region of the heating boiler, a specific temperature regulation is achieved and consequently the ends of the small pipes 7 are prevented from overheating. The mechanical energy received at the driven (power take-off) shaft 11 may be used, for example, to produce electrical energy, whereby it becomes possible to drive this plant, and possibly the building in which the plant is located, autonomously. In this case, the electrical energy may be used to drive a heat pump. The exhaust gases from the burner enter exhaust gas line 12. The hot water preliminary outlet pipe 13 and also the return pipe 14 can also be seen.

Figure 2:
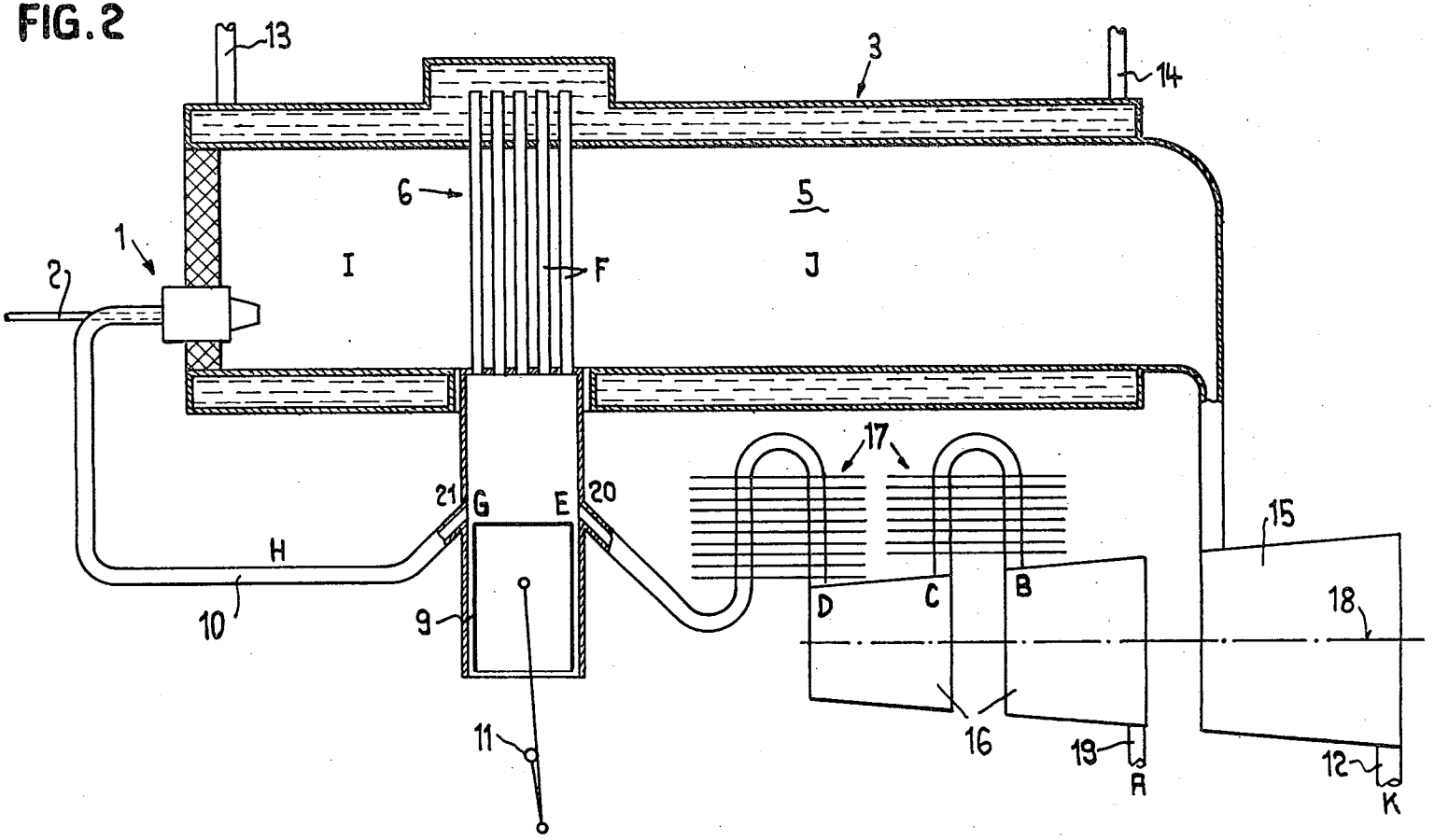
FIG. 2 illustrates the use of the engine in a power plant having a group of compressors.

FIG. 2 shows a heating power plant having a gas turbine. In FIG. 2, the same elements are given the same reference numerals as in FIG. 1. A gas turbine 15 having a compressor group 16 and intermediate coolers 17 can be seen at the outlet of the combustion plant. The driven (power take-off) shaft of the gas turbine is denoted by 18. Fresh air enters the cylinder inlet 20 from the inlet 19 through the compressor groups 16 and the intermediate coolers 17 and is driven into the small pipes of the heat exchanger in the compression phase of the piston, is heated and enters the supply line 10 of the burner 1 via the cylinder outlet 21.

Figure 11:
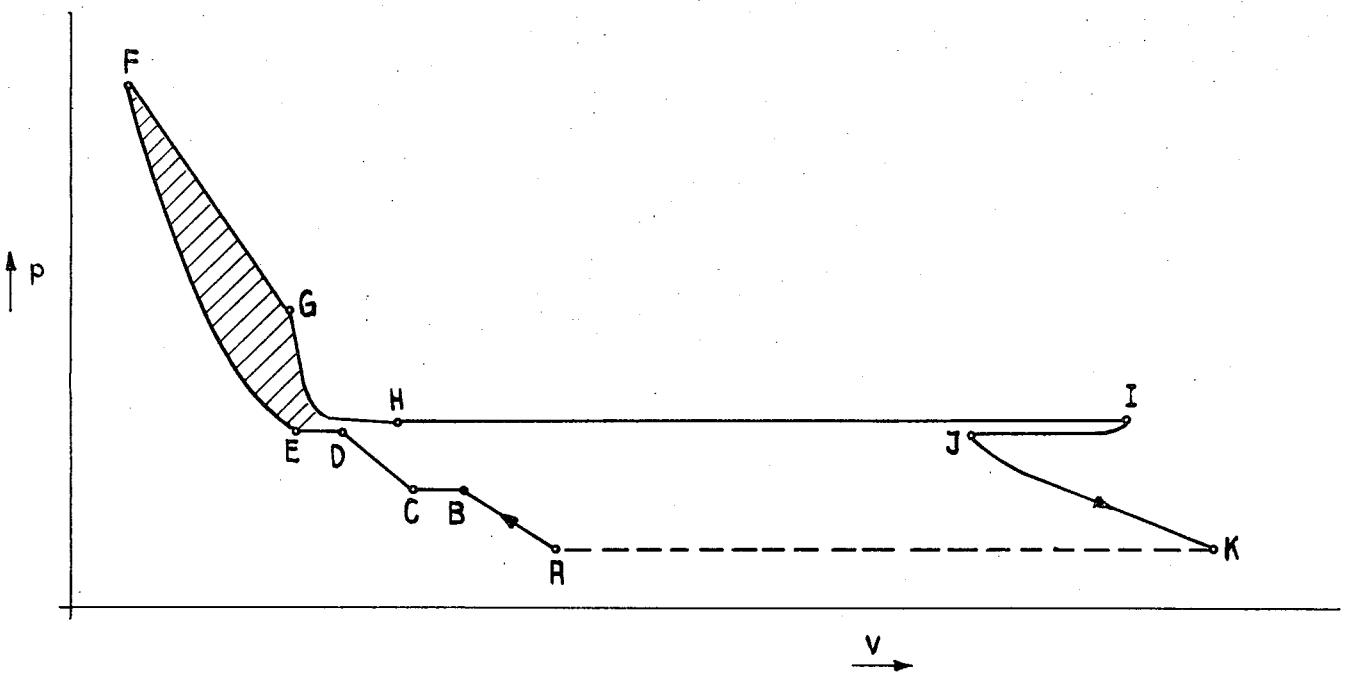
FIG. 11 is a working circulation diagram for the embodiment shown in FIG. 2.

FIG. 11 is a working diagram of this air cycle. The air passes through the inlet 19, point A, and is compressed in the compressor group and intermediate cooler, points B, C, D, and enters the cylinder at E. Subsequently, the compression phase occurs from points E to F in the heat exchanger, and the expansion and working phases occur at the cylinder outlet and in the supply line to the burner, points G and H. Because of the heat supply in the burner and with constant pressure, the gas increases in volume, point I, and is cooled down by the heat exchanger, point J, and expanded in the gas turbine, point K, so as to enter the exhaust gas pipe. It can be seen that the hatched area signifies the additionally obtained work or energy at the driven shaft 11 of the hot-air engine, while the remaining area corresponds to the energy at the gas turbine shaft 18.

Figure 4:
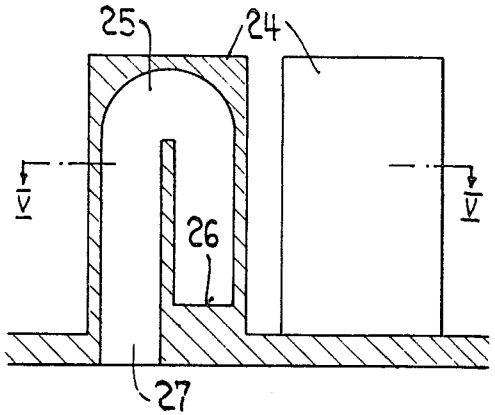
FIGS. 4 to 10 illustrate portions of further modifications.
Figure 5:
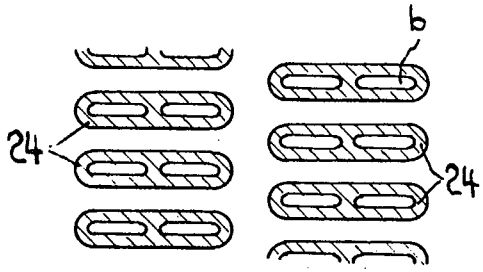
Figure 3:
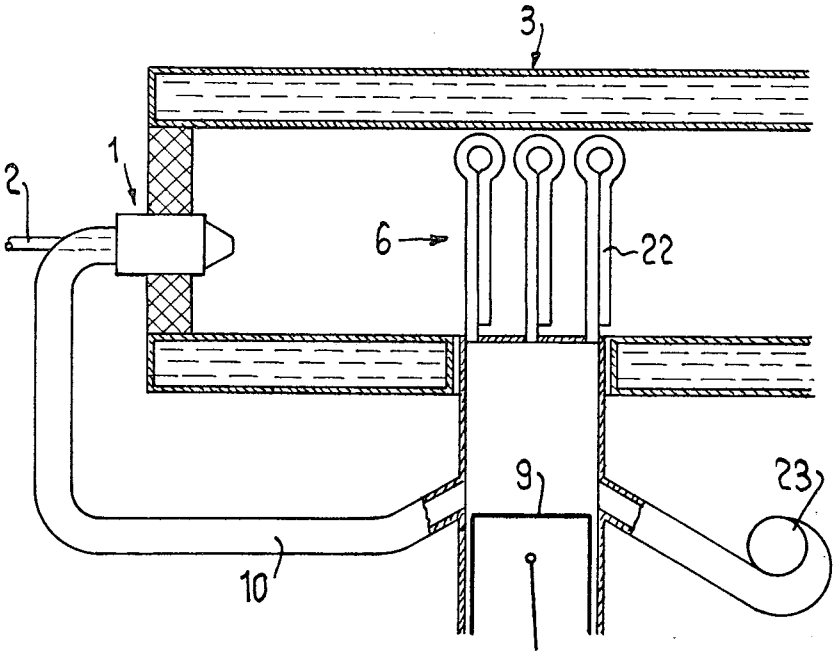
FIG. 3 is an illustration of one modification of the engine.

FIG. 3 shows another improved modification of the apparatus shown in FIG. 1. It is possible to increase the effectiveness of the heat exchanger and to prevent the small pipes or vanes from overheating by curving the small pipes or vanes so that the ends of the air ducts defined thereby are adjacent the inlets (of the air ducts) so that the hot ends of the small pipes or vanes of the compression chamber heat the inlets thereof which are not as hot. As shown in FIG. 3 for example, this may be effected by the small pipes 22 of the heat exchanger being bent round and the ends being joined to the inlets in a heat-conducting manner. In this modification, a pump or blower 23 is used instead of the usual pumping action of the two stroke piston in the crankcase housing. FIG. 4 shows a modification of the small pipes or vanes of the heat exchanger. The vane 24 has a curved air duct 25 and its end 26 is adjacent the beginning 27 and communicates therewith in a heat-conducting manner. The vanes 24 may, for example, be made from alloyed cast iron or another good heat conducting metal. FIG. 5 is a section taken along the line V—V of FIG. 4, the slot width b in the present example being 0.5–5 mm. In this embodiment of the heat exchanger, the air is already pre-heated as it flows into the vanes.

Figure 6:
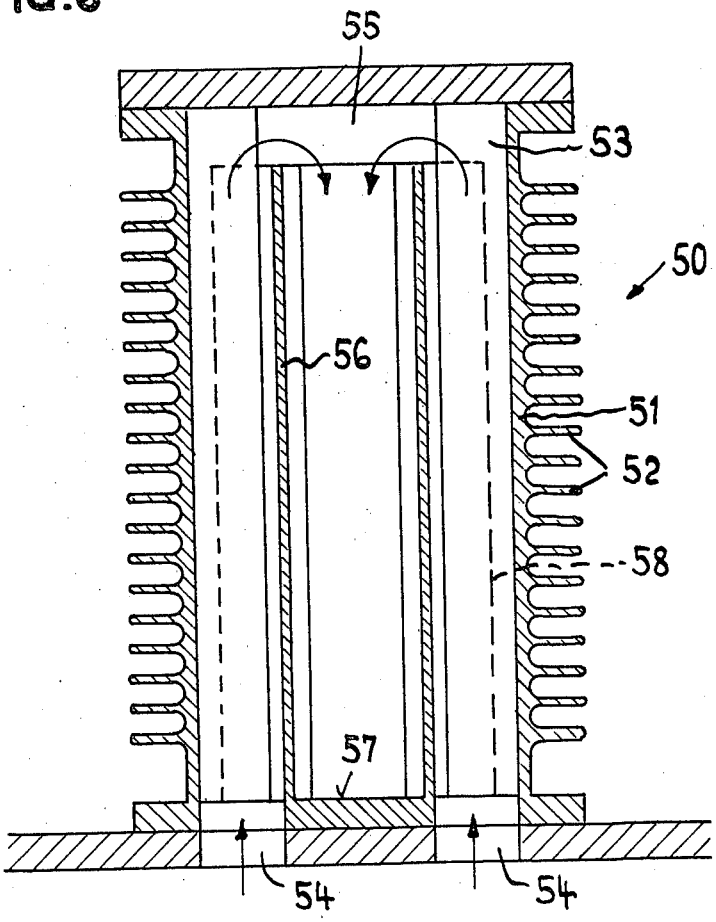
Figure 7:
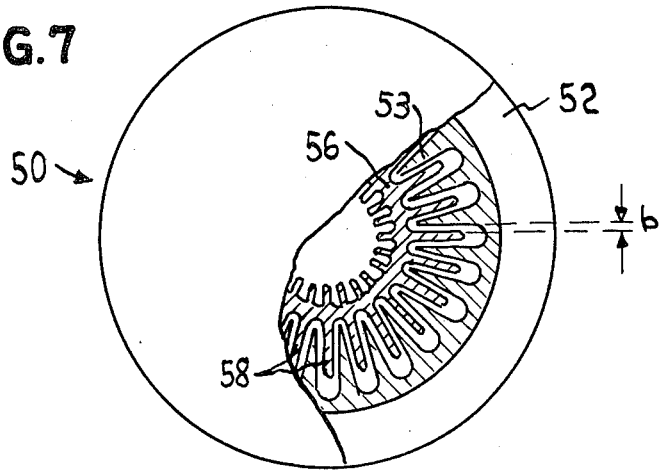

FIGS. 6 to 10 show schematically certain further embodiments. FIG. 6 and its section FIG. 7 show one modification wherein the heat exchanger 50 comprises round hollow bodies which are provided internally and externally with ribs. The external hollow body 51 with external ribs 52 is heated externally by the flame and transmits its heat, through the wall and internal ribs 53, to the air flowing in at 54. The particularly intensely heated quantity of air enters internal hollow body 56 at the top at 55, the internal hollow body 56 being closed or sealed at 57, and transmits the heat partially via ribs 58 to the air flowing in at 54, so that the entire amount of air in the compression chamber is brought substantially to the same temperature. The slot width b is again in the millimeter range.

Figure 8:
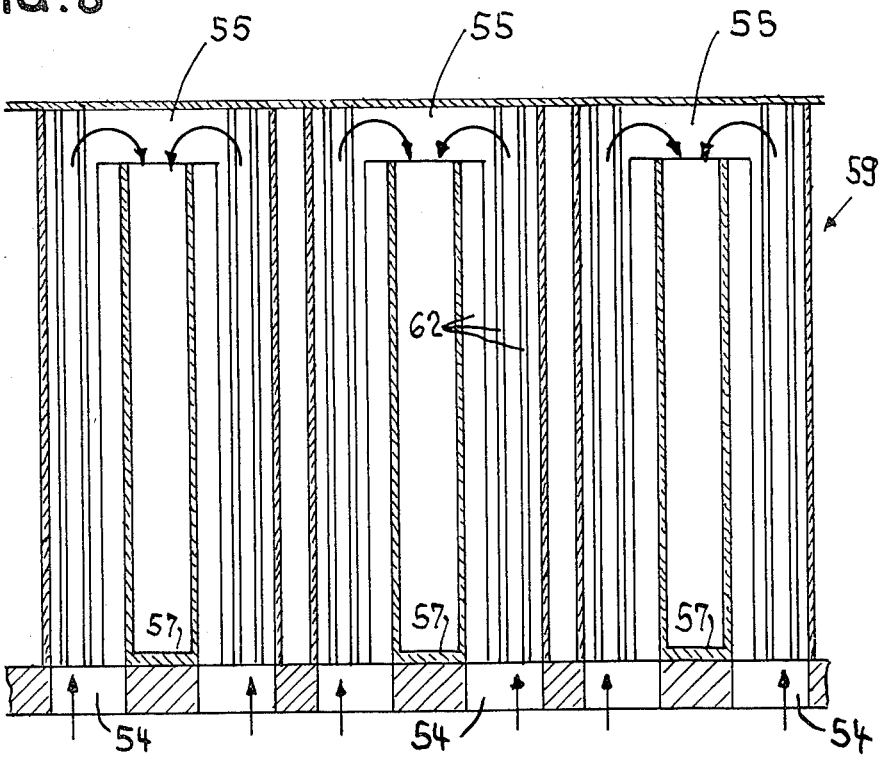
Figure 9:
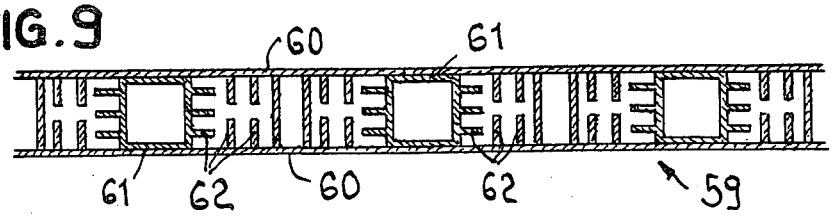

FIG. 8 and its section FIG. 9 show a further modification wherein heat exchangers 59 each comprise an outer hollow body 60 and an inner hollow body 61 which are not cylindrical but rectangular and comprise ribs 62.

Figure 10:
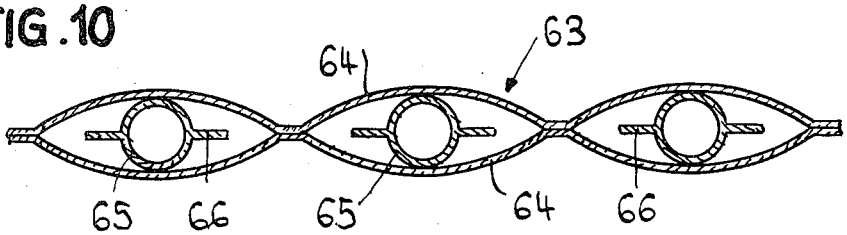

FIG. 10 shows another embodiment wherein heat exchangers 63 are produced from bent welded sheets of metal which form an outer hollow body 64 and an inner hollow body 65 which are provided with ribs 66. The mode of operation is similar to that in the preceding examples.

From the above examples, it follows that the large area and vanelike heat exchangers may be produced by drawing, turning, reaming, milling, pressing, bending, welding or casting, i.e. in practice by all standard production processes. It must always be ensured thereby that the air conduits remain small so that a large heat exchanging area is produced and that, additionally the rate of flow of the compressed air in these small intermediate spaces is also sufficiently high so that a good transmission of heat to the compressed air is possible. In some embodiments, this transmission of heat must occur within 40 ms. However, to avoid relatively high throttle losses in the heat exchanger, it is advisable to keep the flow speed in the small pipes or vanes substantially constant. For this purpose, these air conduits or ducts are designed so that they taper slightly from the inlet 27 or 54 i.e. the cross-section of the air conduits should be greater as the entry than at the deflection point 25 or 55 respectively, or at the end points 26 or 57 respectively.

A further increase in efficiency and especially of combustion may also be achieved in that the flame front pulsates. In this case, the number of piston cylinders and the length and design of the air supply line 10 are adapted so that the flame oscillates between the two points S1 and S2. An appropriate adaptation of this oscillation causes the flame front to be located in the vicinity of the heat exchanger, i.e. at S2, always at a time which is favourable for the transmission of heat, i.e. when the piston is in the top dead centre. In addition, this pulsation is beneficial to the transmission of heat.

Figure 12:
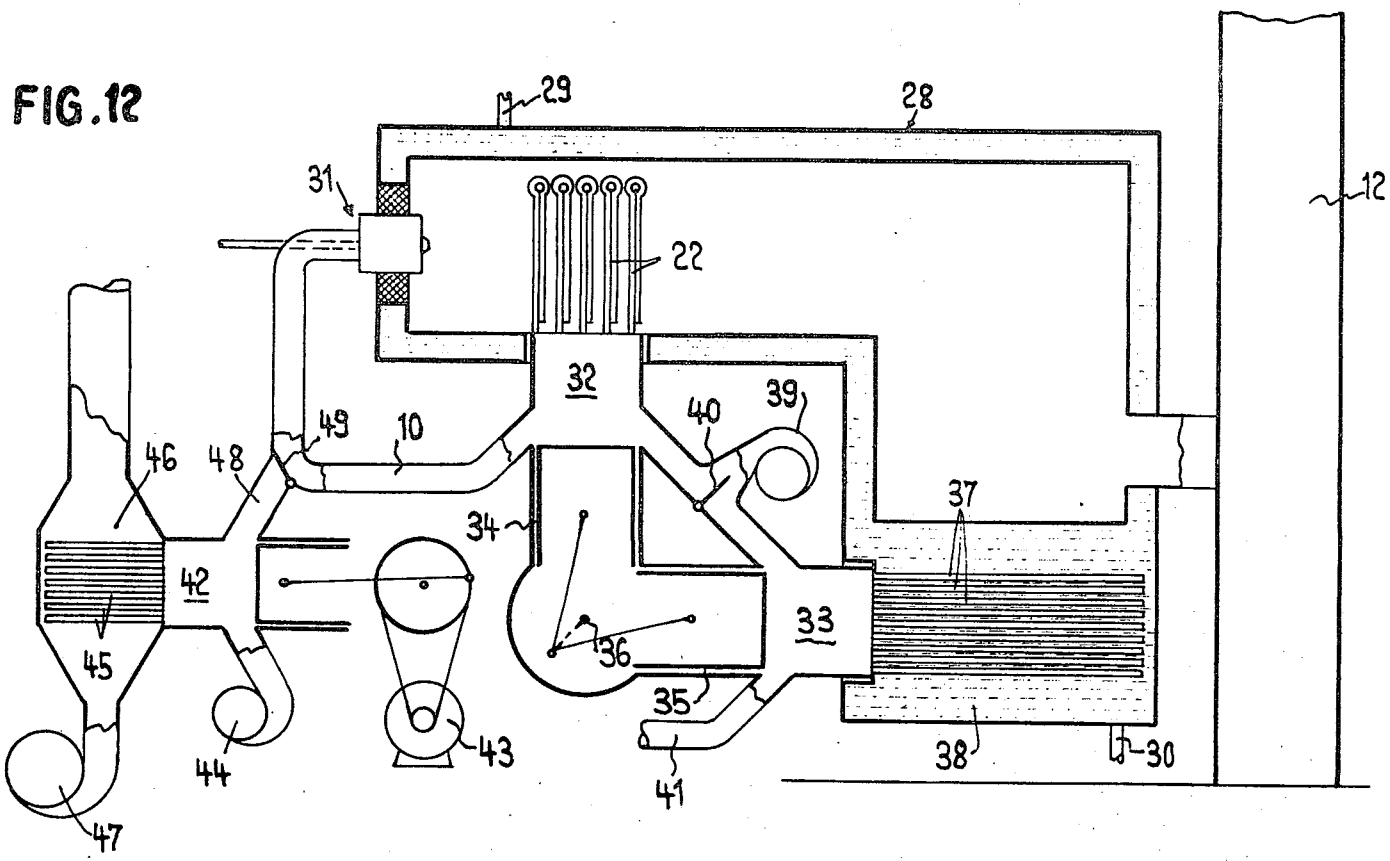
FIG. 12 is a schematic illustration of a further embodiment using a hot-gas piston-type engine as a heat pump and as a refrigeration machine.

FIG. 12 shows one example of using hot-gas piston type engines wherein a total of three such apparatuses or engines are used which permit the autonomous operation of a heat pump and a refrigeration unit. A heating boiler 28 can be seen with a hot water preliminary or outlet pipe 29 and also a return pipe 30 and burner 31 can be seen. The first hot-air engine 32 is designed as in the preceding embodiment shown in FIG. 3, wherein the small pipes or vanes 22 may also be designed differently, for example in a manner similar to that shown in FIGS. 4 to 10. The first hot-air engine 32 drives a second hot-air piston-type engine 33 which is radially staggered or offset relative to the first engine 32 and which is designed as a heat pump. The pistons 34 and 35, respectively, of the two engines are located on the same shaft 36 and are radially staggered or offset 90° relative to each other. The heat exchanger 37 of the heat pump projects into a boiler chamber 38 of the heating boiler—the cool, return water flowing into this chamber. Since the heat exchanger operates at substantially relatively low temperatures and in the water, materials therefor may be used other than where used in the case of the small pipes of the heat exchanger which come into contact with the hot and corrosive gases of the burner flame. However, it is also important in this case for the small pipes or vanes of the heat exchanger 37 to ensure a rapid transmission of the heat produced therein by the compression of the air to the surrounding water. The two engines are supplied with the required fresh air by a common blower or fan 39 having a regulating flap valve 40.

The mode of operation of this combined hot-air engine and heat pump is as follows: The shaft 36, driven by the hot-air engine 32, drives the pistons 35 of the heat pump which compresses the fresh air (coming from the fan 39) in the small pipes of the heat exchanger 37, which serve as an upper compression chamber of the engine 33, and heats it to approx. 100° to 300° C. The heat contained in the hot compressed air is transferred to the water in the boiler chamber 38 via the heat exchanger 37, whereby the water contained therein is heated to approximately 50° to 90° C. This is an advantage over the conventional heat pumps which only permit hot water to be heated up to approx. 50° C. The expanded air which has cooled to, for example 0° C. to −30° C. passes to the outside via an outlet 41 but it may also be needed for refrigeration purposes, for example for operating a refrigeration or cooling plant. In this case, the cylinder groups, on the one hand, and the fresh air supply line, on the other hand, must be adapted to each other and controlled.

If a heating plant of this type or of a different type is to be used as a refrigeration device, a further hot-gas piston-type engine may be used as a refrigeration unit which operates in principle like a reverse-running heat pump. The air piston machine 42 is driven by an electric motor 43 and a similar combination to that described above is also possible for driving this machine. The air coming from the fan 44 is compressed and heated in the small pipes of the heat exchanger 45. The heat exchanger 45 projects into a refrigeration chamber 46 through which air is driven by means of a fan 47. This air causes the compressed and heated air to be cooled also via the heat exchanger 45 and to be cooled during expansion, for example, −20° C. This cooled air passes, via the outlet 48 and the opened valve 49 (shown in FIG. 12 in the closed or heating position), into the burner supply line 10 and thence into the heating boiler where it can reduce the preliminary water temperature to substantially 5° C. when the refrigeration unit is suitably dimensioned. The air which is driven by fan 47 through the refrigeration chamber 46 and, which is heated by the compressed air contained within the heat exchanger 45 to substantially 80°–120° C., may be used to heat the serviceable water. Since the present case involves an air heat exchanger 45, the material and the dimensions for the small pipes or vanes of the heat exchanger 45 must be adapted thereto. However, the serviceable water may also be heated indirectly by means of the heat exchanger 45 when no hot air is needed. In the case of an engine which is designed as a heat pump and is driven by a motor, the heat exchanger may transmit its heat to the heating medium, the water, oil or air. In this case it is advantageous for the heating medium to be additionally circulated by means of a pump or fan.

Various other possible variations in the design of the heat exchanger or in the use of the gas piston engines are also possible. Thus, the diameter of the small pipes or vanes may vary within a wide range, whereby a range of 1–5 mm $\phi$ and a length of 100–1000 mm may be covered advantageously, and preferably a diameter, or respectively a slot width b of 1.5–3 mm and a length of 400–600 mm are used. In this case, the wall thickness and especially also the surface design and the material are adapted to the circumstances, i.e. for case of a heat exchanger in the region of the burner flame or in a fluid medium such as water or in air. A number other than two cylinders may also be selected.

In the case of the apparatus shown in FIG. 2, another heating boiler may also be involved, for example, one which does not produce hot water. When no hot water generation is required, the combustion chamber may be given a fireproof casing. However, in this case it must be ensured that the ends of the small pipes are not excessively heated and that they are cooled.

I claim:

1. A hot-gas piston-type engine comprising at least one cylinder having a first wall portion defining a first compression space and a second wall portion defining a second compression space, said second compression space being in fluid communication with said first compression space;

a reciprocable piston disposed in said first compression space for reciprocating movement therein and for contact with compressible fluid in said first compression space;

crank means connected to said piston for converting reciprocating piston motion to rotational motion;

inlet means for intake of fluid into said cylinder;

outlet means for exhaust of fluid from said cylinder; and heat exchanger means for contact with a heat transfer medium, said heat exchanger means comprising said second compression space and said second wall portion of said cylinder, said second compression space being empty during operation of the engine except for the presence of compressible fluid communicated into said second compression space from said first compression space.

2. An engine according to claim 1, wherein said heat exchanger means comprises a plurality of suitably disposed small pipes the interior wall portions of which define said second compression space.

3. An engine according to claim 2, wherein the small pipes are bent around and the ends are joined to the inlets thereof in a heat-conducting manner.

4. An engine according to claim 2, wherein the vanes each have a curved air duct whose end is joined to the inlet thereof in a heat-conducting manner.

5. An engine according to claim 1, wherein 100 to 200, preferably 150 small pipes are used, per 1000 $cm^3$ cylinder capacity, with a diameter of 1 to 5 mm, preferably 1.5 to 3 mm, and a length of 100 to 1000 mm, preferably 400 to 600 mm.

6. An engine according to claim 1, wherein it includes crankcase scavenging means.

7. An engine according to claim 1, including a fan for introducing compressible fluid into said cylinder.

8. An engine according to claim 1, which, when used in a heating plant with an oil or gas burner having a burner chamber, comprises said outlet means for exhaust fluid being connected to the burner and said heat exchanger means projecting into the burner chamber.

9. An engine according to claim 8, wherein the end of the heat exchanger protrudes into the hot water of the boiler so as to prevent the small pipes or vanes from overheating.

10. An engine according to claim 1 whenever used in a gas turbine plant having a group of compressors, wherein the compressor group is connected to the cylinders of the machine and its outlet is connected to the burner.

11. An engine according to claim 10, wherein the ends of the small pipes, vanes or ribs of the heat exchanger, which protrude into the burner chamber, are protected from overheating.

12. An engine according to claim 1 which, when used in a heating power unit which includes a burner having a boiler chamber, comprises a first cylinder and piston arrangement operating as a heat pump and a second cylinder and piston arrangement driven by the burner, the piston associated with said second cylinder being drivingly connected to the same shaft which, in turn, drives the piston of said first cylinder, the piston of said first cylinder reciprocating in a path which is radially offset relative to the reciprocating path of the piston of said second cylinder, the radial offset being measured relative to a line passing through the length of the shaft which is driven by the burner via the piston of said second cylinder and which drives the piston of said first cylinder.

13. An engine according to claim 12 wherein the heat exchanger means of said first cylinder and piston arrangement operating as the heat pump projects into said boiler chamber so as to be in heat transmitting association therewith.

14. An engine according to claim 12 wherein both of said first and second cylinder and piston arrangements are connected to a common fan for introducing compressible fluid into the cylinders, said fan having a control valve for selectively introducing the compressible fluid into said first and second cylinders.

15. An engine according to claim 1, which when used in a refrigeration apparatus, comprises said heat exchanger means defined by said second compression space of said cylinder being traversed by a medium which absorbs the heat produced in said second compression space by the compression of the fluid contained therein.

16. An engine according to claim 15, which when used in combination with a heating and refrigeration plant having a burner which is supplied with a combustion medium through a valved supply line, wherein said medium which absorbs heat is fed as the combustion medium to the burner through the valved supply line by means of a fluid communicating connection between the outlet of the cylinders of the engine and the burner supply line via a control valve.

17. An engine according to claim 15, wherein the heat exchanger means protrudes into a refrigeration chamber, which is fed with a heat transfer medium by a fan and the heat transfer medium heated there is used to heat serviceable water.

18. An engine according to claim 15, wherein the heat exchanger means protrudes into a refrigeration chamber, which is fed with a heat transfer medium by a fan and the heat transfer medium heated there comprises serviceble water.

19. An engine according to claim 1, which when used as a driven heat pump transmits the heat from the compressible fluid in said heat exchanger means to heat transfer medium in contact with said heat transfer means and the heat transfer medium is additionally put into circulation.

20. The engine according to claim 1 wherein compressible fluid is introduced into said inlet and further comprising:

drive means connected to said crank means for driving said piston; and a heat transfer medium, said heat exchanger means being in contact with said heat transfer medium;

such that the driven engine operates as a heat pump to transfer heat to the heat transfer medium from the compressible fluid.

21. The engine according to claim 1, wherein the engine produces mechanical power when the heat transfer medium transfers heat to the heat exchanger means and wherein the engine transfers heat to the heat transfer medium through the heat exchanger means when the crank means is driven by a mechanical power source.

22. A hot-gas piston-type engine comprising:

at least one cylinder having a compression space;

a reciprocable piston in the cylinder for contact with compressible fluid in the compression space;

crank means connected to said piston for converting reciprocating piston motion to rotational motion;

inlet means for intake of fluid into said cylinder;

outlet means for exhaust of fluid from said cylinder; and a heat exchanger for contact with a heat transferring medium, wherein the heat exchanger is constructed to act as a portion of said compression space for the cylinder of said engine, and wherein the heat exchanger is comprised of a plurality of suitably disposed small pipes which are provided with inner and outer ribs.

23. An engine according to claim 5, wherein said pipes define curved ducts, said ducts having an open inlet end for receiving compressible fluid and a closed second end which terminates at a point adjacent said open inlet end, said open inlet end and said closed second end of said ducts being associated one with the other in a heat-conducting manner.

24. An engine according to claim 4 or 23 wherein the width of the air conduit lies between 0.5 and 5 mm.

25. An engine according to claim 23 wherein the width of said ducts is greater at said open inlet end than at said closed second end.

26. The engine according to claim 5, which when used in a heating power unit which includes a burner having a boiler chamber, comprises a first cylinder and piston arrangement operating as a heat pump and a second cylinder and piston arrangment driven by the burner, the piston associated with said second cylinder being drivingly connected to the same shaft which, in turn, drives the piston of said first cylinder, the piston of said first cylinder reciprocating in a path which is radially offset relative to the reciprocation of the piston of said second cylinder, the radial offset being measured relative to a line passing through the length of the shaft which is driven by the burner via the piston of said second cylinder and which drives the piston of said first cylinder.

27. An engine according to claim 26, wherein the heat exchanger means of said first cylinder and piston arrangement operating as the heat pump projects into said boiler chamber so as to be in heat transmitting association therewith.

28. An engine according to claim 26 wherein both of said first and second cylinder and piston arrangements are connected to a common fan for introducing compressible fluid into the cylinders, said fan having a control valve for selectively introducing the compressible fluid into said first and second cylinders.

* * * * *